US010054414B2

(12) United States Patent
Scheid et al.

(10) Patent No.: US 10,054,414 B2
(45) Date of Patent: Aug. 21, 2018

(54) EXPLOSIVE ASSEMBLY SYSTEMS INCLUDING A LINEAR SHAPED CHARGE END PRIME CAP APPARATUS AND RELATED METHODS

(71) Applicant: The United States of America as represented by the Secretary of the Navy, Washington, DC (US)

(72) Inventors: Eric Scheid, Bloomington, IN (US); Dan Thomas, Southern Pines, NC (US); Brad Moan, Greenwood, IN (US); Tom Gailey, Spring Lake, NC (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/721,406

(22) Filed: Sep. 29, 2017

(65) Prior Publication Data

US 2018/0038670 A1 Feb. 8, 2018

Related U.S. Application Data

(62) Division of application No. 14/953,312, filed on Nov. 28, 2015, now Pat. No. 9,778,008.

(Continued)

(51) Int. Cl.

*F42D 1/04* (2006.01)
*C06C 5/06* (2006.01)

(Continued)

(52) U.S. Cl.

CPC ..... *F42D 1/043* (2013.01); *F42B 1/028* (2013.01); *F42B 1/04* (2013.01); *F42B 3/08* (2013.01);

(Continued)

(58) Field of Classification Search

CPC .... F42B 1/02; F42B 1/028; F42B 1/04; F42B 3/08; F42B 3/087; F42B 3/26; F42D 1/04; F42D 1/043; C06C 5/06

(Continued)

(56) References Cited

U.S. PATENT DOCUMENTS 2,543,057 A * 2/1951 Porter ..... F42B 1/02 102/307
3,165,057 A * 1/1965 Armstrong ..... F42B 1/02 102/307

(Continued)

FOREIGN PATENT DOCUMENTS

DE 3123250 1/1983
DE 3123250 A1 * 1/1983 ..... C06C 5/04

(Continued)

*Primary Examiner* — James S Bergin
(74) *Attorney, Agent, or Firm* — Christopher A. Monsey

(57) ABSTRACT

Generally, embodiments of the invention can include a linear shaped charge (LSC) end cap coupling structure adapted for holding an initiator structure adapted to initiate a booster explosive material, the booster explosive material, and the LSC in abutting contact with each other. One embodiment includes a rubber body formed with cavities adapted to receive the LSC, booster, and initiator structure (e.g., detonation cord). One internal cavity can be formed with a plurality of flexible protrusions or fins which are oriented towards a center axis of the preferred embodiment of three cavities configured to impart an interference fit with the initiator structure. Methods related to the invention are also provided.

10 Claims, 6 Drawing Sheets

Related U.S. Application Data

(60) Provisional application No. 62/249,679, filed on Nov. 2, 2015.

(51) Int. Cl.

| | |
|---|---|
| ***F42B 1/028*** | (2006.01) |
| ***F42B 3/26*** | (2006.01) |
| ***F42B 3/08*** | (2006.01) |
| ***F42B 3/087*** | (2006.01) |
| ***F42B 1/04*** | (2006.01) |

(52) U.S. Cl.
CPC ..... *F42B 3/087* (2013.01); *F42B 3/26* (2013.01); *C06C 5/06* (2013.01)

(58) Field of Classification Search
USPC ..... 102/275.2, 275.3, 275.4, 275.5, 275.6, 102/275.7, 275.12, 307
See application file for complete search history.

(56) References Cited

U.S. PATENT DOCUMENTS 3,185,089 A * 5/1965 Parkhurst ..... F42B 1/02 102/307
3,335,664 A * 8/1967 Enzian ..... B21D 28/007 102/307
4,987,818 A * 1/1991 Alford ..... C06B 21/0033 102/307
6,112,666 A * 9/2000 Murray ..... F42D 1/043 102/275.12
6,435,095 B1 * 8/2002 Menzel ..... F42B 3/12 102/275.11
8,402,892 B1 * 3/2013 Scheid ..... C06C 5/06 102/217
8,479,557 B2 * 7/2013 Bottlinger, Jr. ..... G01N 3/313 73/12.01
9,778,008 B2 * 10/2017 Scheid ..... F42D 1/043
2005/0183610 A1 * 8/2005 Barton ..... C06C 5/06 102/275.11
2012/0192748 A1 * 8/2012 Scheid ..... C06C 7/00 102/275.11

FOREIGN PATENT DOCUMENTS

DE 3520490 10/1986
DE 3520490 A1 * 10/1986 ..... C06C 5/06
GB 2140137 11/1984
GB 2140137 A * 11/1984 ..... C06C 5/06

* cited by examiner

EXPLOSIVE ASSEMBLY SYSTEMS INCLUDING A LINEAR SHAPED CHARGE END PRIME CAP APPARATUS AND RELATED METHODS

CROSS-REFERENCE TO RELATED APPLICATIONS

The present application claims priority to U.S. Non-Provisional patent application Ser. No. 14/953,312, filed Nov. 28, 2015, entitled "EXPLOSIVE ASSEMBLY SYSTEMS INCLUDING A LINEAR SHAPED CHARGE END PRIME CAP APPARATUS AND RELATED METHODS," the disclosure of which is related to U.S. Provisional Patent Application Ser. No. 62/249,679, filed Nov. 2, 2015, entitled "LINEAR SHAPED CHARGE END PRIME CAP APPARATUS AND RELATED METHODS," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200,465) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

The present invention relates to explosive assembly systems suitable to couple different explosive components together in a field setting and related methods. In particular, one exemplary explosive assembly system can include an initiator structure that improves initiation and detonation of a linear shaped charge (LSC). For example, end priming of LSCs can be made more efficient, reliable, safer, and simpler over existing approaches, e.g., hand taped methods. Some embodiments of this disclosure can include an initiation apparatus configured to engage with a "V" cross section of LSCs so can be referred to herein as a "V-Prime". While one example of the present invention can include one or more exemplar V-Prime designs, fitted to 4000 gr/ft CLSC, LSCs come in many cross-sections of explosive load. An exemplary V-Prime design can be adapted to receive various explosives or LSC designs and shapes. A V-Prime as discussed with regard to at least some embodiments of the invention can include a body, e.g., a rubber end cap, with a hollow neck designed to fit snuggly onto an end of a piece of LSC and provide a structure for assembling or attaching and retaining a detonator cord with a variety of new advantages and capabilities.

Various approaches in existence have substantial disadvantages. For example, use of tape to assemble LSC pieces including taping an explosive sheet booster and a detonator together can be done in a field setting. However this approach has numerous disadvantages such as unreliability, etc.

Recent improvements in response time and availability of capabilities for rapid prototyping materials have raised a possibility and practicality of introducing custom components that increase the efficiency, reliability, safety, and simplicity of the detonation. For example, one embodiment of a V-Prime improves assembly and use of LSCs in a variety of ways. First, an exemplary V-Prime makes LSC easier to use by adding a manufactured structure to the end of the charge that simplifies priming the charge. Priming the charge involves accurately placing a detonator, detonation cord (detcord), or other initiating device. Priming was traditionally done by wrapping tape around the detonator, LSC, and explosive sheet booster, if required. Adding a manufactured structure however, simplifies priming, thus making the LSC easier to use. Second, the V-Prime makes the LSC more reliable by placing explosive sheet booster material in secure, direct contact with the explosive core of the LSC. Previously, the explosive sheet booster material was either taped on top of the charge, or across the end of the LSC, and then a detonator was placed and taped into or on the explosive sheet booster. Taping explosive sheet booster material on top of the LSC required either filing or removing parts of the LSC metal wall. Filing the LSC metal jacket, or removing parts of the LSC metal wall by other means to reach the explosive core for a reliable initiation could be very dangerous. Additionally the explosive sheet booster material was in parallel to the LSC, which decreased the performance of the detonator. Taping explosive sheet booster material across the end involved placing material along a small cross-section, which is less secure, and 90° from the optimal direction to pass the shock front from the explosive sheet booster to the LSC. Therefore, the V-Prime provides a major improvement in securing the contact between the explosive sheet booster material and the explosive core by providing internal cavities that securely house the necessary components (explosive sheet booster, detcord, LSC). In addition, the V-Prime makes the LSC more reliable. Third, the V-Prime makes the LSC safer by protecting the explosive ends of the LSC from impacts and drops. The V-Prime provides a rubber "bumper" to protect the exposed explosive ends of the LSC. Protecting the exposed ends improves the safety of the overall device. Fourth, the V-Prime improves the performance of the LSC. LSCs typically take up to three inches of their length to run-up, or detonate to optimal performance. End priming the LSC with the V-Prime device gives the charge added momentum by reducing the typical run-up distance. Also, because the V-Prime is placed on the end of the charge, and not placed across the top of the charge, the LSC is not over primed. Over priming occurs when a top mounted explosive sheet booster disrupts the effect of the LSC, and further increases the necessary run-up.

Additionally, the explosive sheet booster loaded exemplary V-Primes can be transported on the LSC to the point of operation because the explosive sheet booster materials in the V-Prime are of the same hazard class as the LSC. Therefore, in an exemplary embodiment of the device, when on target, the user inserts a detonator into the neck of the V-Prime and initiates the charge with a detonator from a safe distance.

According to an illustrative embodiment of the present disclosure, some features of one embodiment, e.g., an explosive assembly or LSC End Prime Cap, can include: (1) In-line priming where the priming can be optimally done on the same axis that the LSC will detonate on. This improves the performance of the LSC. (2) Secure explosive sheet booster attachment where the inside of the V-Prime can be sized to fit explosive sheet, flexible boosters, explosive sheet boosters or all types of boosters. Without an embodiment, e.g., the V-Prime, a user is required to use undesirable field assembly approaches such as taping explosive booster material to a side of the LSC, thus creating an unsecured explosive sheet booster attachment. (3) An incorporation of another structure, a U-Prime including a well structure, where the U-Prime allows for quick, versatile and secure insertion of the detonator. Various embodiments of an exemplary V-Prime can be designed to fit other sizes of LSC. Additionally, there may be other demolition related uses for charges other than LSC that benefit from a rubber end priming sleeve predominantly of these features.

Generally, embodiments of the invention can include a coupling or assembly structure adapted for holding various components including an initiator structure adapted to initiate an explosive sheet booster explosive material, the explosive sheet booster material, and the LSC in abutting contact with each other. One embodiment includes an elastomeric or rubber body formed with cavities adapted to receive the LSC, explosive sheet booster, and initiator structure (e.g., detonation cord). One internal cavity can be formed with a plurality of flexible protrusions or fins which are oriented towards a center axis of the three cavities configured to impart an interference fit with the initiator structure or detonator cord. Methods of use are also provided.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
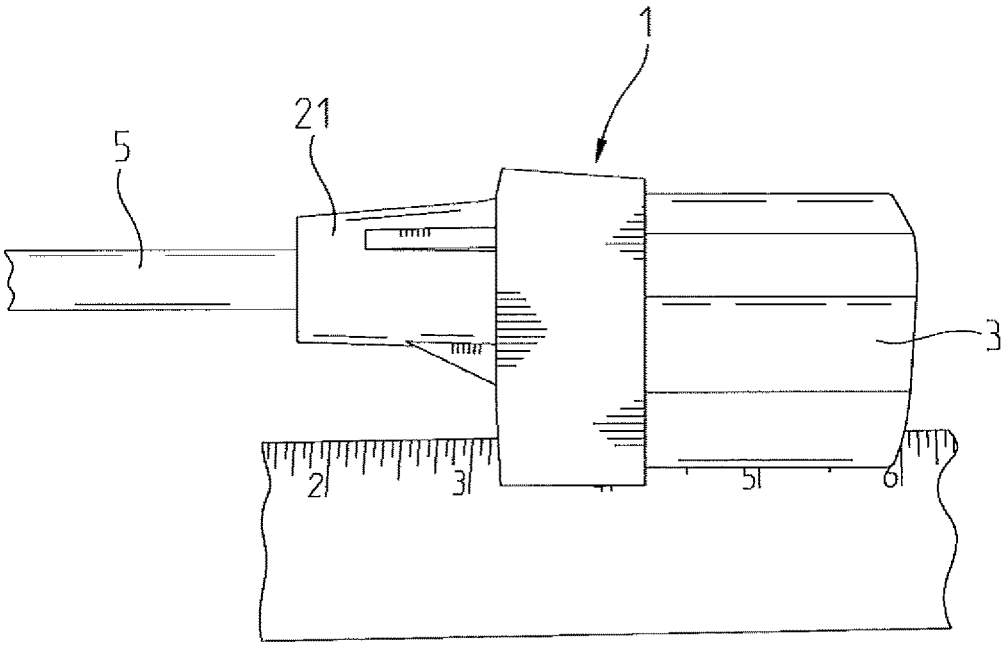
FIG. 1 shows an exemplary side view of a V-Prime structure and LSC inserted into the V-Prime structure.

FIG. 1 shows an exemplary side view of a V-Prime 1 and LSC 3. An exemplary V-Prime 1 can be made of molded elastomeric material, such as rubber, fitted to house an appropriate LSC 3 material on one end, and a detonator cord (detcord) 5 on another end with a booster explosive material (not shown) inserted between the two within the V-Prime 1. When in use, a user could insert detcord 5 into a detcord insertion end 21 of exemplary V-Prime 1 and initiate the LSC and booster explosive with an appropriate detonator from a safe distance. In one exemplary embodiment of the V-Prime 1, explosive sheet booster and user-installed booster explosives in the V-Prime 1 can be of a same hazard class as the LSC 3 so booster loaded V-Primes 1 can be transported on the LSC 3 to a point of use. One exemplary LSC 3 material can be formed with a minimum of 8-10 inches or up to 6 feet in length.

Figure 2:
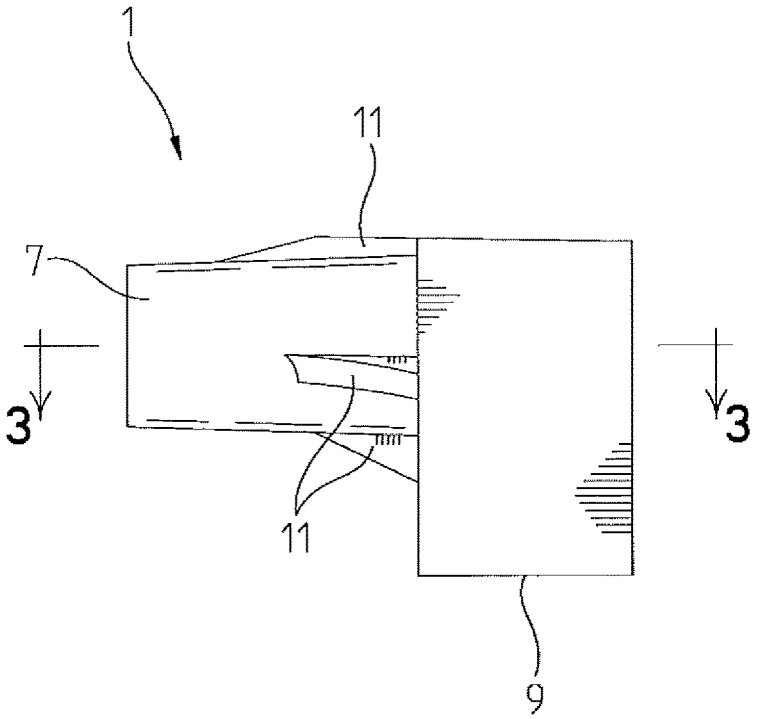
FIG. 2 shows an outer view of the exemplary V-Prime structure.

FIG. 2 shows an outer view of the exemplary V-Prime 1. The V-Prime 1 can be a rubber structure that primes an end of the LSC charge and allows for safer, easier, more efficient insertion of the detcord 5 (not shown) into a neck protrusion 7 of the V-Prime 1. Stiffeners 11 formed onto external portions of the V-Prime 1 support the neck protrusion area 7, of the V-Prime 1 to increase rigidity of the neck protrusion 7 with respect to remaining portions of the V-Prime 1. An LSC insertion shaft 9 of the V-Prime 1 be formed to receive and retain the LSC 3 with a semi-rigid or flexible gripping interference fit. In one exemplary embodiment of the V-Prime 1, a V-Prime 1 can be placed over an end of the LSC 3 with or without any booster material to serve as a coupling structure, thus improving safe handling of the charge.

Figure 3:
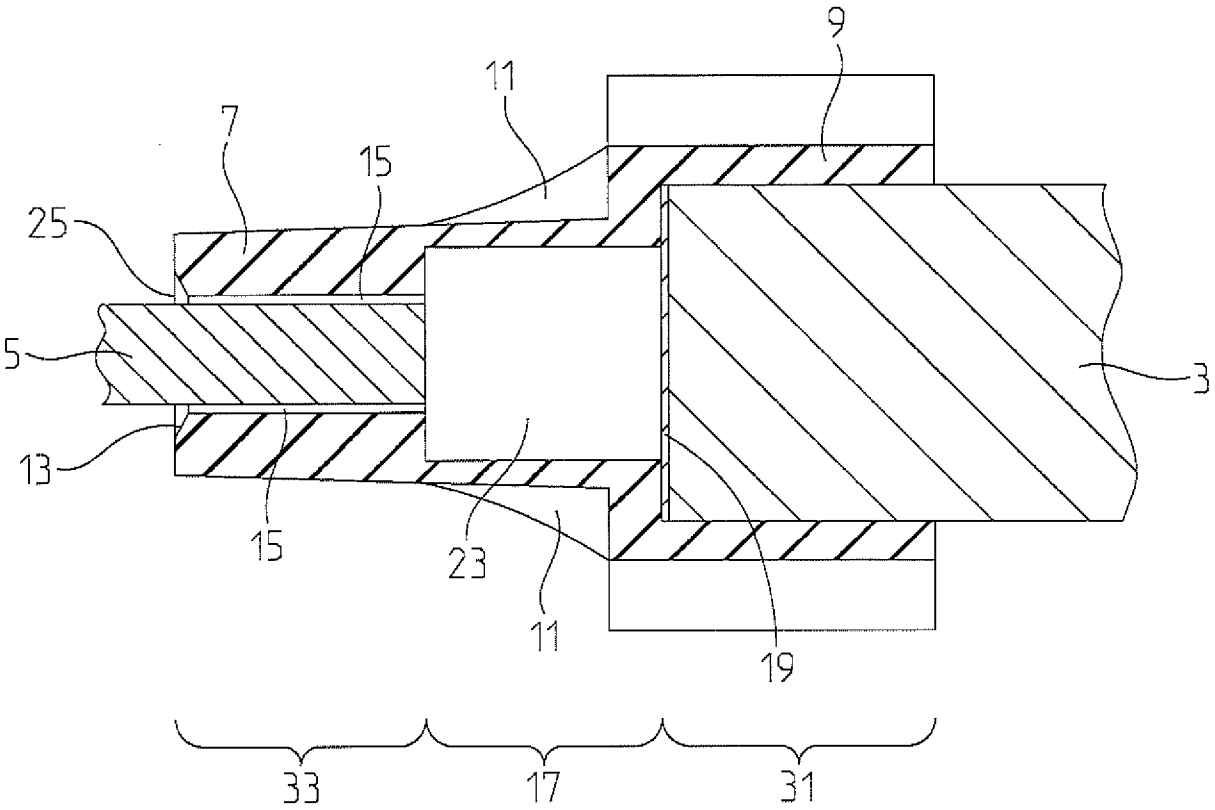
FIG. 3 shows a first internal cross sectional view of the exemplary V-Prime and LSC.

FIG. 3 shows a first internal cross sectional view of exemplary V-Prime 1 and LSC 3. An internal cavity 17, or third cavity, of the V-Prime 1 can be sized to contain user installed booster explosive 23, e.g., a partial MK 140 flexible booster explosive. In particular, a neck protrusion 7 of this exemplary V-Prime 1 can be formed with the internal cavity 17 for the user installed booster explosive 23. Stiffeners 11 buttress the neck protrusion 7 to the shaft 9, and increase rigidity and structural integrity for the neck protrusion 7. Shaft 9 of V-Prime 1 within a first cavity 31 internal to the LSC insertion shaft 9 insertably receives and grips the LSC 3, and can have an internal cavity for a thin layer, e.g., on the order of 1/16 of an inch of explosive sheet booster 19. Explosive sheet booster 19 can be positioned vertically to a center insertion axis of the V-Prime 1 internal cavity 17 and in direct contact with an exposed end of the LSC 3. The user installed booster explosive 23 can be positioned adjacent to and in direct contact with both the explosive sheet booster 19 and the detcord 5 on opposing sides of the user installed booster explosive 23. As with the explosive sheet booster 19, user installed booster explosive 23 can be cut and placed inside the V-Prime 1 by the user before slipping the V-Prime 1 over the exposed end of the LSC 3 into the first cavity 31. The neck protrusion 7 of the V-Prime 1 has an open end 25 extending along said first axis for detcord 5 insertion. This exemplary open end 25 can be circumferentially lined with a plurality of flexible fins 15 to accept and secure blasting caps, detonators and detonating cord. Bevel 13 can be sloped to an angle, such as an exemplary 158 degrees, to facilitate in the insertion of the detcord 5 into the neck protrusion 7. The angle of the bevel 13 can be formed by the shape of the open end 25 and the plurality of flexible fins 15. Internal cavity 17 can open into a second cavity 33 which is internal to the neck protrusion 7.

Figure 4:
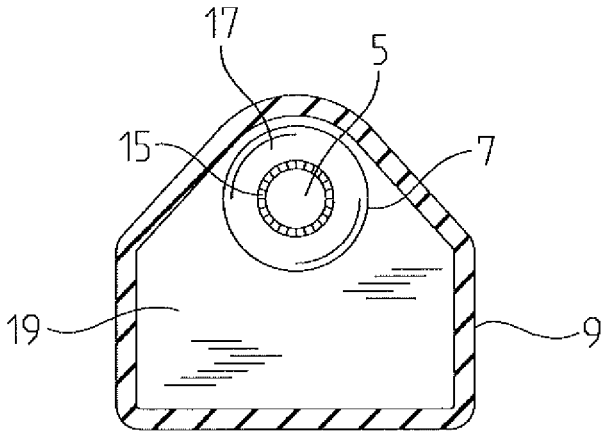
FIG. 4 shows a second internal cross sectional view of the exemplary V-Prime structure.

FIG. 4 shows a second internal cross sectional view of the exemplary V-Prime 1. Shaft 9 of the V-Prime 1 can be a hexagonal shape that can be fitted to contain a V-shaped LSC 3 (not shown). Shaft 9 of V-Prime 1 is designed to contain and grip the LSC 3, and internal cavity 17 can hold explosive sheet booster 19. Shaft 9 of V-Prime 1 securely grips the end of LSC 3 with a compression fit. Shaft 9 cuts explosive sheet booster 19 to the shape of shaft 9. This built-in cutting feature of shaft 9 cuts explosive sheet booster 19 to the exact shape required to fit into internal cavity 17 of V-Prime 1, up to the internal shoulder (not shown) of internal cavity 17. Neck protrusion 7 of V-Prime 1 can be sized to contain user installed booster explosive 23. The user installed booster explosive 23, would be positioned vertically to the axis in neck protrusion 7 of V-Prime 1 and in direct contact with explosive sheet booster 19 which directly contacts the end of LSC 3 (not shown). Detcord 5 can be securely gripped by the plurality of flexible fins 15.

Figure 5:
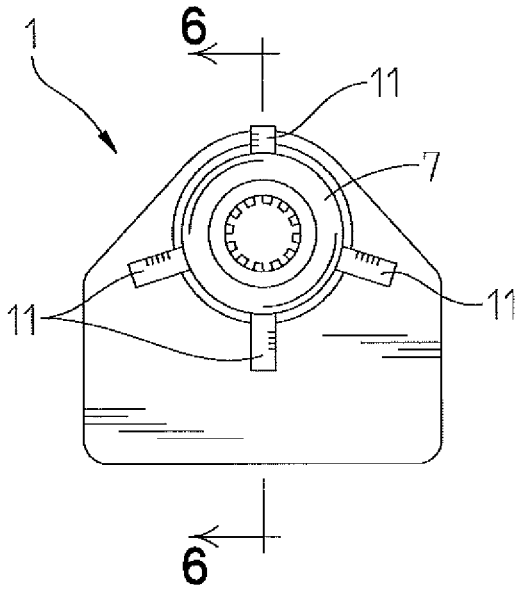
FIG. 5 shows a third cross sectional view of the exemplary V-Prime structure.

FIG. 5 shows a third cross sectional view of exemplary V-Prime 1. V-Prime 1 can have one or more external supporting stiffeners 11 around neck protrusion 7. Stiffeners 11 circumferentially support and reinforce neck protrusion 7.

Figure 6:
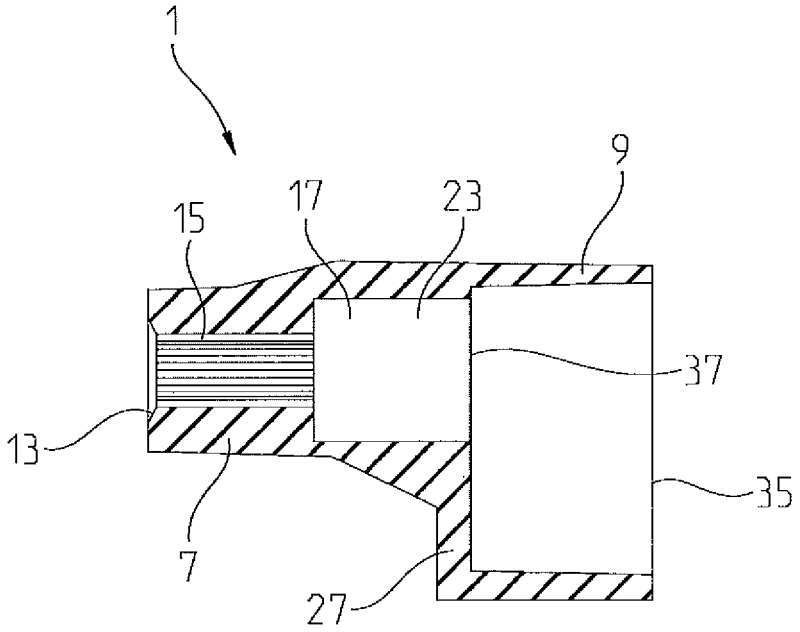
FIG. 6 shows a fourth internal cross sectional view of the exemplary V-Prime structure.

FIG. 6 shows a fourth internal cross sectional view of exemplary V-Prime 1. Here, the rubber material of shaft 9 and neck protrusion 7 is represented by the lined outer area of the figure. Explosive sheet booster 19 (not shown) can be in direct contact with user installed booster explosive 23. The plurality of flexible fins 15 grab onto detcord 5 (not shown). Bevel 13 facilitates the insertion of detcord 5. Explosive sheet booster 19 (not shown) can be positioned nearly all the way to internal shoulder 27 of V-Prime 1. The shaft 9 can have a first aperture 35 on one end of the V-Prime 1, and a second aperture 37 on an opposing end of the V-Prime 1 opening into the neck protrusion 7.

Figure 7:
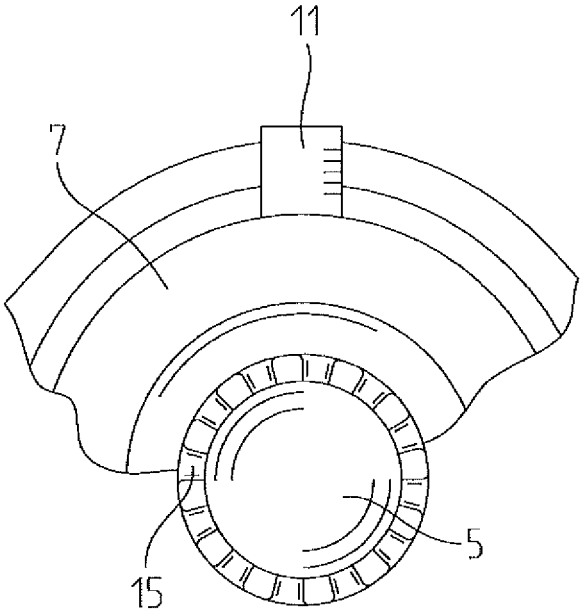
FIG. 7 shows an exemplary cross sectional view of U-Prime fins in a neck protrusion section of the V-Prime structure.

FIG. 7 shows an exemplary cross sectional view of a plurality of flexible fins 15 in neck protrusion 7 of the V-Prime 1. Detcord 5 is inserted in a circular tube shaped area created by the plurality of flexible fins 15 in neck protrusion 7. A supporting stiffener 11 is shown flanking neck protrusion 7. In one exemplary embodiment, V-Prime 1 incorporates the plurality of flexible fins 15 in the design of a direct insert universal detonator well (U-Prime) fins in neck protrusion 7. U-Prime fins provide a secure insertion of various diameter detonator cords without the need for a specialized adapter.

Figure 8A:
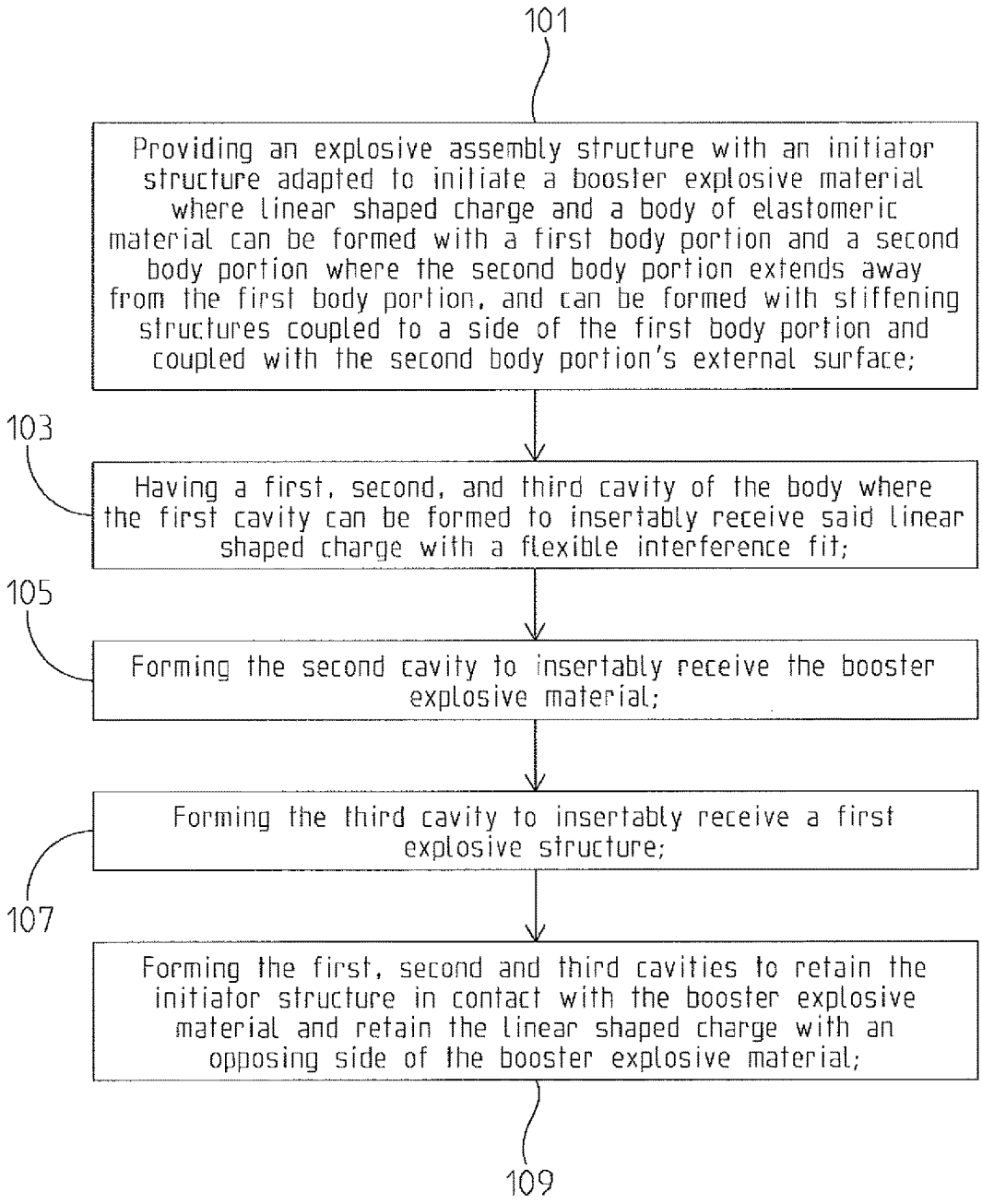
FIG. 8*a* shows an exemplary method in accordance with one embodiment of the invention.

Referring to FIG. 8*a*, a method is provided that includes: Step 101: Providing an explosive assembly structure with an initiator structure adapted to initiate a booster explosive material where linear shaped charge and a body of elastomeric material can be formed with a first body portion and a second body portion where the second body portion extends away from the first body portion, and can be formed with stiffening structures coupled to a side of the first body portion and coupled with the second body portion's external surface. Step 103: Having a first, second, and third cavity of the body where the first cavity can be formed to insertably receive said linear shaped charge with a flexible interference fit. Step 105: Forming the second cavity to insertably receive the booster explosive material. Step 107: Forming the third cavity to insertably receive a first explosive structure. Step 109: Forming the first, second and third cavities to retain the initiator structure in contact with the booster explosive material and retain the linear shaped charge with an opposing side of the booster explosive material.

Figure 8B:
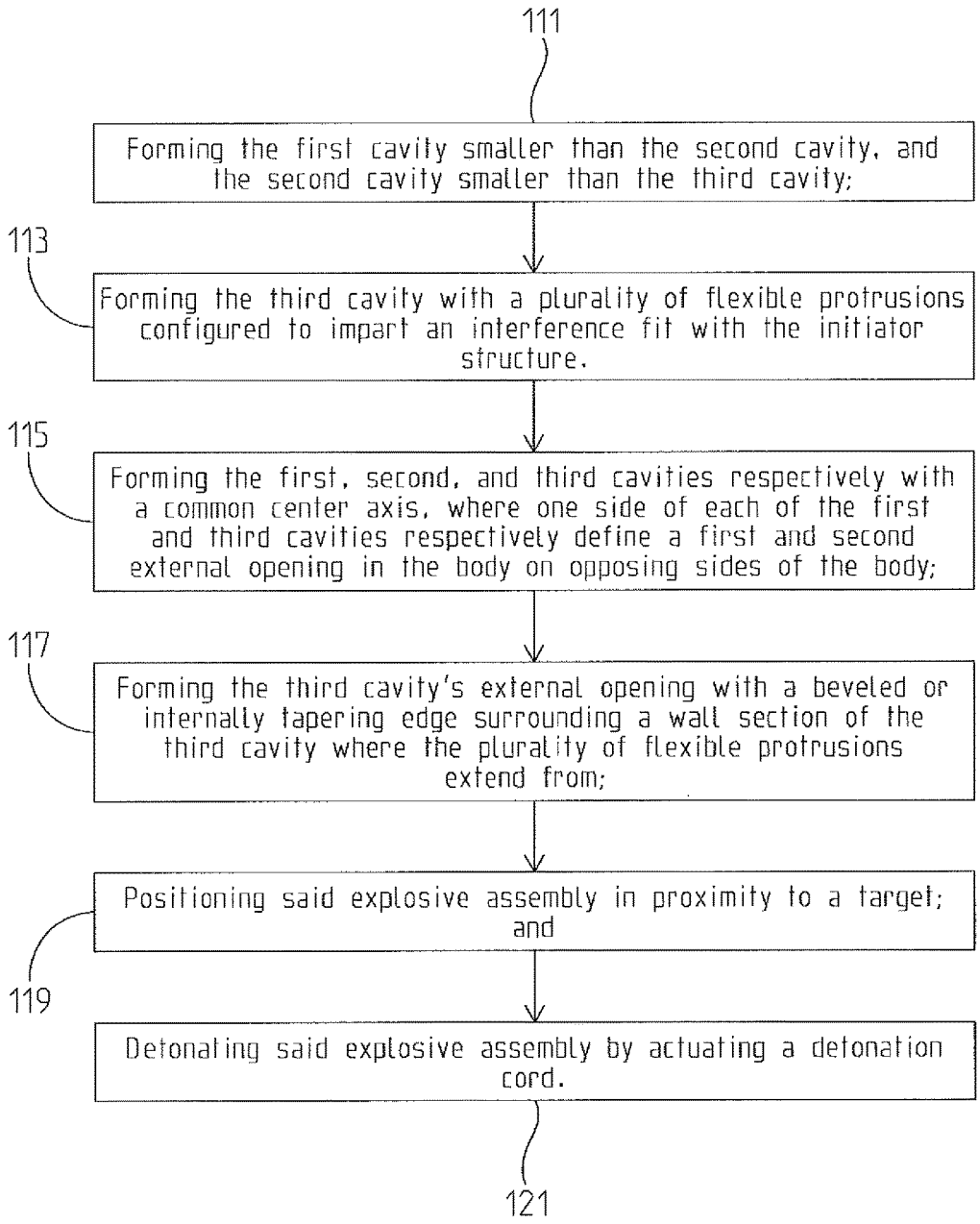
FIG. 8*b* shows a continuation of the FIG. 8*a* method.

Referring to FIG. 8*b*, FIG. 8*a* continues at Step 111: Forming the first cavity smaller than the second cavity, and the second cavity smaller than the third cavity. Step 113: Forming the third cavity with a plurality of flexible protrusions configured to impart an interference fit with the initiator structure. Step 115: Forming the first, second, and third cavities respectively with a common center axis, where one side of each of the first and third cavities respectively define a first and second external opening in the body on opposing sides of the body. Step 117: Forming the third cavity's external opening with a beveled or internally tapering edge surrounding a wall section of the third cavity where the plurality of flexible protrusions extend from. Step 119: Positioning said explosive assembly in proximity to a target; and Step 121: Detonating said explosive assembly by actuating a detonation cord.

Methods of use can also include providing an exemplary V-Prime 1 such as described above, including detonation cord 5, booster sheet explosive 19, and LSC 3 inserted into the V-Prime 1 in physical contact. Next, the V-Prime 1 assembly with detonator cord 5, booster sheet explosive 19, and LSC 3 are positioned relative to a target surface. Next, the detonation cord 5 is actuated so as to detonate the booster sheet explosive 19 and LSC 3. Methods of manufacturing can include forming the V-Prime 1 with internal cavities dimensioned to receive and retain the LSC 3, booster sheet explosive 19, and detonation cord 5 coupling the LSC 3, booster sheet explosive 19 as described herein.

Although the invention has been described in detail with reference to certain preferred embodiments, variations and modifications exist within the spirit and scope of the invention as described and defined in the following claims.

The invention claimed is:

1. A coupling structure comprising:

a body formed from an elastomeric material comprising a shaft end section and an opposing neck protrusion section, wherein said shaft end section and neck protrusion section are formed respectively with a first and second aperture that open into a first and second cavity section within said body, said first and second cavity sections open into each other, wherein said first cavity section is formed with a first interior cavity wall having a first distance between opposing sides of said first cavity section, wherein said second cavity section is formed with a second interior cavity wall having a second distance between opposing sides of said second cavity section, wherein the first distance is larger than the second distance;

wherein said shaft end section is formed with a flexible interference fit adapted to receive and retain a linear shaped charge (LSC) up to a first force;

wherein said second cavity section within said neck protrusion section is formed comprising a plurality of spaced apart protrusions or fins that extend a first distance away from said second cavity section wall towards a common center axis, wherein said plurality of spaced apart protrusions or fins are adapted or formed to displace, securely grip, and retain a initiator structure inserted into said second cavity through said neck protrusion up to a second force;

wherein said neck protrusion section comprises a plurality of external stiffening sections adapted to increase structural rigidity of said neck protrusion formed on an exterior wall of said neck protrusion section and coupled to a portion of said shaft end section that extends away from said neck protrusion section.

2. A coupling structure as in claim 1, wherein said plurality of spaced apart protrusions or fins extend into said second cavity less than half of a distance defined by a radius from said common center axis of said second cavity to said second interior cavity section wall.

3. A coupling structure as in claim 1, wherein said second aperture into said second cavity is formed having an angled bevel surrounding said second aperture wherein said angled bevel is formed to facilitate insertion of said initiator structure.

4. A coupling structure as in claim 1, wherein said first cavity is adapted to receive an explosive sheet booster and hold said explosive sheet booster in contact with said LSC upon insertion of said LSC into said shaft end section, said coupling structure further formed to hold said initiator structure in contact with a user installed booster on an opposing side of said explosive sheet booster from said LSC.

5. A coupling structure as in claim 4, further comprising said LSC, said explosive sheet booster, said user installed booster, and said initiator structure.

6. An explosive assembly including a coupling structure comprising:

a body formed from an elastomeric material comprising a shaft end section and an opposing neck protrusion section; wherein said shaft end section and opposing neck protrusion section are formed respectively with a first and second aperture that open into a first and second cavity section within said body, said first and second cavity sections open into each other, wherein said first cavity section is formed by a first interior cavity wall having a first distance between opposing sides of said first cavity section, wherein said second cavity section is formed by a second interior cavity wall having a second distance between opposing sides of said second cavity section, wherein the first distance is larger than the second distance;

a linear shaped charge (LSC);

wherein said shaft end section is formed with a flexible interference fit adapted to receive and retain the linear shaped charge up to a first force;

wherein said second cavity section within said opposing neck protrusion section is formed comprising a plurality of spaced apart protrusions or fins that extend a third distance away from said second interior cavity wall, wherein said plurality of spaced apart protrusions or fins are adapted or formed to displace, securely grip; and retain a initiator structure inserted into said second cavity section through said opposing neck protrusion up to a second force;

wherein said opposing neck protrusion section comprises a plurality of external stiffening sections adapted to increase structural rigidity of said opposing neck protrusion formed on an exterior wall of said opposing neck protrusion section and coupled to a portion of said shaft end section that extends away from said opposing neck protrusion section.

7. An explosive assembly as in claim 6, wherein said plurality of spaced apart protrusions or fins extend into said second cavity section less than half of a distance defined by a radius from a common center axis of said second cavity section to said second interior cavity section wall.

8. An explosive assembly as in claim 6, wherein said second aperture into said second cavity section is formed having an angled bevel surrounding said second aperture wherein said angled bevel is formed to facilitate insertion of said initiator structure.

9. An explosive assembly as in claim 6, wherein said first cavity section is adapted to receive a sheet booster explosive material and hold said sheet booster explosive material in contact with said LSC upon insertion of said LSC into said shaft end section, said explosive assembly further formed to hold said initiator structure in contact with a booster explosive material on an opposing side of said sheet booster explosive material from said LSC.

10. An explosive assembly as in claim 9, further comprising said sheet booster explosive material, said booster explosive material, and said initiator structure.

* * * * *